United States Patent [19]

Solomon

[11] 4,377,496

[45] Mar. 22, 1983

[54] GAS DIFFUSION ELECTRODE AND PROCESS

[75] Inventor: Frank Solomon, Great Neck, N.Y.

[73] Assignee: Diamond Shamrock Corporation, Dallas, Tex.

[21] Appl. No.: 260,408

[22] Filed: May 4, 1981

[51] Int. Cl.[3] ..... C25B 11/02; C25S 11/06

[52] U.S. Cl. ..... 252/425.3; 204/283; 204/290 R; 204/291; 204/292; 427/122; 427/352; 427/353;

[58] Field of Search ..... 204/290 R, 291–293, 204/283; 427/122, 352, 353; 252/425.3

[56] References Cited

U.S. PATENT DOCUMENTS

| | | | |
|---|---|---|---|
| 3,385,780 | 5/1968 | Feng | 204/294 |
| 3,838,064 | 9/1974 | Vogt et al. | 252/384 |
| 4,058,482 | 11/1977 | Baris et al. | 252/425.3 |
| 4,135,995 | 1/1979 | Welch | 204/98 |
| 4,150,076 | 4/1979 | Baris et al. | 264/49 |
| 4,170,540 | 10/1979 | Lazarz et al. | 204/296 |
| 4,177,159 | 12/1979 | Singer | 252/428 |
| 4,179,350 | 12/1979 | Deborski | 204/284 |

FOREIGN PATENT DOCUMENTS

| | | | |
|---|---|---|---|
| 1065821 | 8/1957 | Fed. Rep. of Germany | 204/293 |
| 1222172 | 2/1971 | United Kingdom . | |
| 1284054 | 8/1972 | United Kingdom . | |

OTHER PUBLICATIONS

Mao et al., J. Electrochem. Soc., vol. 117 (No. 10), pp. 1319–1323, 10/70.

"On the Effect of Various Active Carbon Catalysts on the Behavior of Carbon Gas-Diffusion Air Electrodes: Alkaline Solutions", by I. Iliev et al., *Journal of Power Sources,* 1 (1976/1977), pp. 35–46, Elsevier Sequoia S.A., Lausanne printed in the Netherlands.

"A Novel Air Electrode", by H. P. Landi et al., *Advances in Chemistry Series,* (1969) American Chemical Society Publications, pp. 13–23.

*Primary Examiner*—F. Edmundson

*Attorney, Agent, or Firm*—John P. Hazzard; Woodrow W. Ban

[57] ABSTRACT

This disclosure is directed to a gas diffusion electrode, e.g., an oxygen (air) electrode, having a conductive, porous, sintered, plaque metal substrate containing generally spherically-shaped anchor site depressions on its active layer-contacting surface; an active layer containing catalyzed or uncatalyzed carbon particles and whose plaque-contacting surface includes anchor portions which interlock with the anchor site depressions and assist in securing the active layer to the plaque substrate, and a hydrophobic backing (wetproofing) layer in contact with the other surface of the active layer. The plaque is made by forming, e.g., by rolling or pressing, the metal powder, preferably silver, containing particulate extractable material on one face or surface thereof into a thin plaque; sintering the plaque containing the extractable material at temperatures of from about 1000° to about 1300° F. for time periods of from about 2 to about 30 minutes and thereafter removing the extractable material to produce a plaque electrode substrate having anchor site depressions in one surface. The active layer material is then deposited, preferably by filtration, on the plaque surface having such depressions followed by depositing the hydrophobic layer, also preferably by filtration.

6 Claims, 2 Drawing Figures

GAS DIFFUSION ELECTRODE AND PROCESS

BACKGROUND OF THE INVENTION

Within the field of electrochemistry, there is a well-known type of an electrolytic cell known as a chlor-alkali cell. Basically this is a cell wherein chlorine gas and caustic soda, viz., sodium hydroxide, are produced by passing an electric current through a concentrated salt (brine) solution containing sodium chloride and water. A large portion of the chlorine and caustic soda for the chemical and plastics industries is produced in chlor-alkali cells. The cathodes employed in such chlor-alkali cells are subjected to the corrosive environment of the caustic soda.

Such cells are divided by a separator into anode and cathode compartments. The separator characteristically can be a substantially hydraulically impermeable membrane, e.g., a hydraulically impermeable cation exchange membrane, such as the commercially available NAFION manufactured by the E. I. du Pont de Nemours & Company. Alternatively, the separator can be a porous diaphragm, e.g., asbestos, which can be in the form of vacuum deposited fibers or asbestos paper sheet as are well known in the art. The anode can be a valve metal, e.g., titanium, provided with a noble metal coating to yield what is known in the art as a dimensionally stable anode. One of the unwanted by-products present in a chlor-alkali cell is hydrogen which forms at the cell cathode. This hydrogen increases the power requirement for the overall electrochemical process, and eliminating its formation is one of the desired results in chlor-alkali cell operation.

Fairly recently, attention has been directed in chlor-alkali cell technology to various forms of oxygen (air) cathodes. Such cathodes can result in significant savings in the cost of electrical energy employed to operate chlor-alkali cells. Estimates indicate that there is a theoretical saving of about 25 percent of the total electrical energy required to operate chlor-alkali cells provided that the formation of hydrogen at the cathode can be prevented. In other words, about 25 percent of the electrical energy employed in a chlor-alkali cell is used to form hydrogen at the cathode. Hence, the prevention of hydrogen formation by the reduction of oxygen at the cathode results in significant savings in the cost of electrical power. This is the major benefit of and purpose for oxygen (air) cathodes. Such cathodes, being in contact with the electrolyte caustic soda, are subjected to the corrosive action thereof. Additionally, there are internal stresses and forces produced by the very reactions occurring at the cathode which tend to cause deterioration, break up of the active layer and bleed through of liquid in the wetproofing (backing) layer of such electrodes.

One known form of oxygen (air) cathode involves use of an active cathode layer containing porous active carbon particles whose activity in promoting the formation of hydroxide may or may not be catalyzed (enhanced) using precious metal catalyst materials, such as silver platinum, etc. Unfortunately, however, the pores of such active carbon particles may become flooded by the caustic soda thereby significantly reducing their ability to eliminate the formation of hydrogen at the cathode and resulting in decreased operating efficiency. Various attempts have been made to solve this wettability problem, e.g., by providing a backing layer which is hydrophobic to reduce the likelihood of wetting or flooding of the carbon particles in the active layer by the catholyte liquor. Various forms of polytetrafluoroethylene (PTFE) have been utilized for this purpose. With the use of PTFE, however, comes the problem of reduced electrical conductivity in the cathode active layer in as much as PTFE, per se, is nonconductive. Some oxygen (air) cathodes contain PTFE in both the active layer and in a backing sheet laminated thereto. Such PTFE has been employed in particulate or fibrillated (greatly attenuated and elongated) form to impart hydrophobicity to the desired layer. Thus it can be seen that the development of corrosion-resistant oxygen (air) cathodes of improved durability for use in conjunction with chlor-alkali cells is an overall objective in the field of electrochemistry.

U.S. Pat. No. 4,058,482, Baris et al, discloses an active layer sheet material principally comprised of a polymer such as PTFE and a pore-forming material wherein the sheet is formed of coagglomerates of the polymer and the pore former. This patent teaches mixing polymer particles with positively charged particles of a pore former, e.g., zinc oxide, to form coagglomerates thereof followed by mixing same with a catalyst suspension so as to form coagglomerates of catalyst and polymer-pore-former agglomerates followed by pressing, drying and sintering these coagglomerates. Subsequent to this sintering, the pore former can be leached out of the electrodes.

U.S. Pat. No. 4,150,076 (a division of U.S. Pat. No. 4,058,482) is directed to the process for forming the sheet of U.S. Pat. No. 4,058,482, said process involving formation of polymer-pore-former coagglomerates, distributing same as a layer on a suitable electrode support plate, for example, a carbon paper, to form a fuel cell electrode by a process which includes pressing, drying, sintering and leaching.

U.S. Pat. No. 4,170,540, Lazarz et al, discloses microporous membrane material suitable for electrolytic cell utilization and formed by blending particulate polytetrafluoroethylene, a dry pore-forming particulate material and an organic lubricant. These three materials are milled and formed into a sheet which is rolled to the desired thickness, sintered and subjected to leaching of the pore-forming material.

U.S. Pat. No. 4,177,159 to R. M. Singer discloses formation of a gas electrode by directly filtering a cosuspension of catalyzed or uncatalyzed carbon particles and PTFE on a carbon paper substrate.

U.S. Pat. No. 4,179,350 to G. A. Deborski is directed to porous oxygen electrodes containing a metal phthalocyanine, particulate finely divided metal powder and a pore former, all fabricated together in an integral porous body form of structure. The electrode body can be made in plaque form.

British Pat. No. 1,284,054, Boden et al, is directed to forming an air-breathing electrode containing an electrolyte within an air-depolarized cell. This air-breathing electrode is made by hot pressing a fluoropolymer sheet containing a pore-forming agent onto a catalyst composition (containing silver) and a metallic grid member. According to page 3 of said British patent, the PTFE-pore-forming agent-paraffin wax containing sheet is subjected to a solvent wash to remove the paraffin wax (lubricant and binder) and then sintered in a sintering furnace at the appropriate temperatures for sintering the fluorocarbon polymer. After the PTFE-containing sheet is sintered and while it still contains the pore-forming particles, it is then ready for application to the catalyst composition of the air electrode for the hot pressing operation. Hot pressing involves the use of pressures ranging from about 5,000 to about 30,000 psi in conjunction with temperatures ranging from about 200° F. to 400° F.

U.S. Pat. No. 3,385,780 to I-Ming Feng discloses a thin, porous electrode consisting of a thin layer of a polytetrafluoroethylene pressed against a thin layer of polytetrafluoroethylene containing finely divided platinized carbon, the platinum being present in amounts of 1.2 to 0.1 mg/cm$^2$ in the electrically conductive face of the thin electrode, viz., the side containing the platinized carbon, i.e., the active layer. A thermally decomposable filler material can be used, or the filler can be a material capable of being leached out by either a strong base or an acid. U.S. Pat. No. 3,385,780 also mentions a single unit electrode involving finely divided carbon in mixture with PTFE.

U.S. Pat. No. 4,135,995 to Cletus N. Welch is directed to a cathode having a hydrophilic portion formed of a solid intercalation compound of fluorine and carbon of the emperical formula $CF_x$, where x ranges from about 0.25 to 1 and preferably ranges from about 0.25 to 0.7. The intercalation compounds of carbon and fluorine are referred to as hydrophilic, fluorinated graphites and graphite fluorides characterized by an infrared spectrum showing an absorption band at 1220 cm$^{-1}$. A layer of hydrophobic material such as polyperfluoroethylene (polytetrafluoroethylene) can be utilized in a hydrophobic portion of the same layer or it can be utilized in the form of a different layer which can be associated with a current carrier layer. The Welch cathode may be utilized as an air (oxygen) cathode.

U.S. Pat. No. 3,838,064 to John W. Vogt et al is directed to a process for dust control involving mixing a finely divided fibrillatable polytetrafluoroethylene with a material which characteristically forms a dust to form a dry mixture followed by sufficient working to essentially avoid dusting. Very small concentrations of PTFE, e.g., from about 0.02 to about 3 percent by weight are employed to achieve the dust control. Corresponding U.S. Pat. No. 3,838,092 also to Vogt et al is directed to dustless compositions containing fibrous polytetrafluoroethylene in concentrations of about 0.02 percent to less than 1 percent, e.g., about 0.75 percent by weight of PTFE based on total solids.

An article entitled "On the Effect of Various Active Carbon Catalysts on the Behavior of Carbon Gas-Diffusion Air Electrodes: 1. Alkaline Solutions" by I. Iliev et al appearing in the *Journal of Power Sources,* 1 (1976/1977) 35, 46, Elseview Sequoia S. A., Lausanne-printed in the Netherlands, at pages 35 to 46 of said Journal describes double-layer, fixed-zone Teflon-bonded carbon electrodes having a gas supplying layer of carbon black "XC" wetproofed with 35 percent Teflon and an active layer consisting of a 30 mg/cm$^2$ mixture of the same wetproof material "XC-35" and active carbon "weight ratio of 1:2.5." These electrodes were sintered at 350° C. under a pressure of 200 kg/cm$^2$ and employed as oxygen (air) cathodes in alkaline test environments.

The publication "Advances in Chemistry Series," copyright 1969, Robert F. Gould, (Editor), American Chemical Society Publications, contains at pages 13 to 23 an article entitled "A Novel Air Electrode" by H. P. Landi et al. The electrode described contains 2 to 8 percent PTFE, is produced without sintering and is composed of graphtic carbon (ACCO Graphite) or metallized graphitic carbon particles blended with a PTFE latex and a thermoplastic molding compound to form an interconnected network which enmeshes the filter particles. This blend is molded into a flat sheet, and the thermoplastic is then extracted.

British Pat. No. 1,222,172 discloses use of an embedded conductive metal mesh or screen (35) within a formed electrode (30) containing a particulate matrix (34) of polytetrafluoroethylene polymer particles (21) in which there are located dispersed electrically conductive catalyst particles (24) which can be silver-coated nickel and silver-coated carbon particles, viz., two different types of silver-coated particles in the PTFE particulate matrix in an attempt to overcome an increase in resistance in the gas diffusion fuel cells to which said British patent is directed.

DETAILED DESCRIPTION OF THE INVENTION

This invention is directed to a gas diffusion electrode, such as an oxygen (air) cathode having a conductive, porous, sintered, metal plaque substrate having anchor site depressions on its active layer-contacting surface, an active layer containing catalyzed or uncatalyzed carbon particles and whose plaque-contacting surface includes anchor portions which interlock with the anchor site depressions of the plaque and assist in securing the active layer to the plaque substrate, and a hydrophobic backing (wetproofing) layer containing polytetrafluoroethylene (PTFE) and a pore former, said wetproofing layer being in contact with the other surface of the active layer, viz., the surface which is not in contact with the substrate and to a method of making it.

Figure 1:
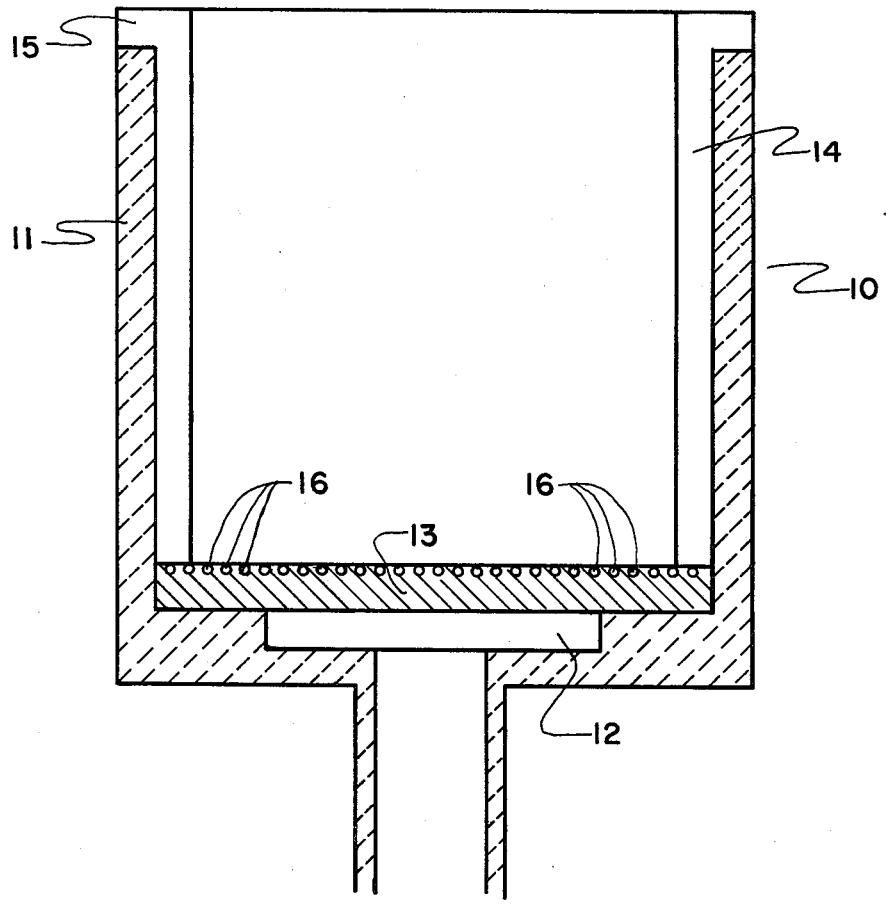
Figure 2:
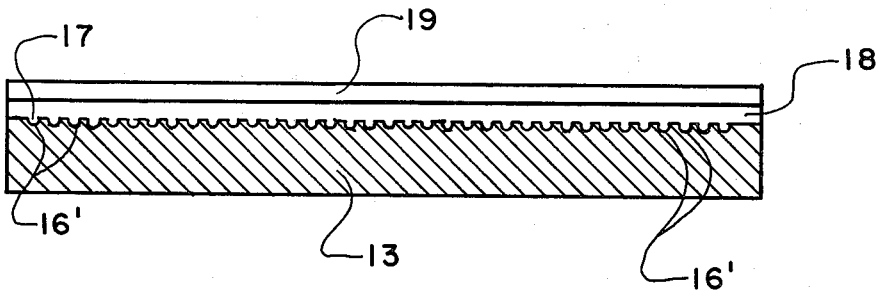

The invention will be described in further detail in conjunction with the drawings in which FIG. 1 is a cross-sectional view of a device useful for forming the substrate plaque metal layer contained in the electrode of this invention, and FIG. 2 is a cross-sectional view illustrating an oxygen (air) electrode prepared according to this invention.

In reference to FIG. 1, there is device 10, for depositing the active layer, e.g., containing carbon, PTFE and catalyst, on the plaque metal substrate. Tubular funnel, 11, has located in its lower central portion a support, 12, for supporting the plaque metal material, 13. Interior wall, 14, having upper peripheral flange, 15, assists in positioning the plaque material, 13.

The plaque substrate, 13, is prepared to have a porosity of from about 50 to 70 percent from metal, e.g., silver powder, each as dendritic powder (battery powder) having a Fisher Sub Sieve particle size in the range of about 2 to about 15 microns by rolling or otherwise pressing it into a thin layer and sintering at a temperature ranging from about 1000° to about 1300° F. for periods of about 2 to about 30 minutes. Although silver is the preferred plaque metal material, other metals such as nickel, titanium, tantalum and equivalent materials may be used.

As will be noted from FIG. 2, extraction of particles, 16, from the upper regions, U, of plaque substrate, 13, results in comparatively large, generally spherically-shaped anchor site depressions (pores), 16', into which the lower anchor portions, 17, of active layer, 18, are formed, as by filtration. A wetproofing (backing) layer, 19, containing a hydrophobic material, e.g., PTFE, is applied to the active layer after it has been filtered onto the plaque. It will be observed that during formation of the active layer, the solid components of the dispersion, slurry (or other media) deposits into the anchor site depressions, 16', to yield anchor portions, 17, which interlock with anchor site depressions, 16', and assist in securing active layer, 18, on plaque substrate, 13.

Suitable particles, 16, of extractable materials which can be employed in upper layer, U, for this purpose include but are not limited to: aluminum powder (particularly spherical aluminum powder); zinc particles or powder; inorganic salts, particularly alkali metal halide salts, viz., those which have a melting temperature above the sintering temperatures employed, e.g., sodium chloride, potassium chloride and like and equivalent materials. The extractable material is removed after the sintering has been completed using a suitable solvent(s), viz., a solvent capable of dissolving the extractable material but not the remainder of the substrate. Of course, the solvent(s) used will depend upon the particular extractable material which is employed to impart the depressions into said surface of the plaque metal substrate, 13. For example, when the extractable material is sodium chloride, it can be removed by washing the plaque with water, preferably hot water. When aluminum powder is employed for this purpose, it can be extracted using a strong caustic solution, e.g., NaOH, KOH, etc. The average particle size of the extractable material determines the average diameter of depressions, 16', and can range from about 120 to about 325 mesh, viz., about 40 to about 120 microns.

THE ACTIVE LAYER

The active layer as utilized in accordance with this invention usually contains some form of carbon, which may or may not be catalyzed to enhance the oxygen reduction reaction taking place within the gas electrode, as in the case of an oxygen (air) cathode. In accordance with this invention, a variety of suitable carbon materials can be used. Such carbons include not only high surface area active carbons and carbon blacks but also partially fluorinated derivatives thereof, viz., materials of the formula $CF_x$, where x ranges from 0.1 to about 0.18.

Suitable carbons include carbon blacks having a high surface area viz., a B.E.T. surface area of from about 250 to 2000 $m^2/g$ (square meters/gram), and more usually from about 600 to about 2,000 $m^2/g$, combined with a particle size ranging from 50 to 3,000 angstrom units. The expression "B.E.T. surface area" refers to the well-known Brunauer-Emmett-Teller method of determining surface area. The carbon blacks which can be used for this purpose embrace a broad spectrum of carbon black materials, e.g., those having a particle size ranging from about 5 to about 300 millimicrons. Such carbon blacks characteristically belong to a family of industrial carbons which includes lamp blacks, channel blacks, furnace blacks and thermal blacks. Insofar as its utilization herein, the term carbon black is as defined in the article entitled "Fundamentals of Carbon Black Technology" by Frank Spinelli as appearing in the *Amercian Ink Maker,* August, 1970.

Such suitable carbon blacks can be steam activated to enhance their surface area usually by contacting said carbon black with steam at temperatures of approximately 1,000° C. for a sufficient period of time to increase the surface area to the values contemplated herein, viz., 250 to about 2,000 $m^2/g$ or higher. Suitable carbon blacks include commercially available materials, such as "XC-72R" which is a carbon black manufactured by Cabot Corporation and has a B.E.T. surface area of approximately 260 $m^2/g$ before steam activation (at approximately 1,000° C.) and a steam-activated surface area ranging from about 1,000 to about 2,000 $m^2/g$.

Another high surface area carbon black which can be used is the commercially available "Ketjenblack EC" sold by Armak Company of Burt, New York (a part of Akzona Corportion). "Ketjenblack EC" has a B.E.T. surface area of approximately 1,000 $m^2/g$.

As noted previously, the carbon particles in the active layer can be active carbon particles. The active carbon whose use is contemplated in accordance with this invention encompass a variety of materials which in general include a variety of amorphous carbonaceous materials, generally of vegetable origin which contain inorganic residue, e.g., noncarbonaceous oxides, collectively designed as ash.

In accordance with one embodiment of this invention, the active carbon starting material is "RB" carbon which is a form of active carbon manufactured by Calgon, a division of Merck, and is made from bituminous coal by known procedures. This material can contain as much as approximately 23 percent of various oxides and components which can be collectively classified as ash. Typical analysis of the ash contained in RB carbon is as follows:

| Component | Weight Concentration |
|---|---|
| Silica | 43.34 |
| Alumina ($Al_2O_3$) | 29.11 |
| Iron Oxides ($Fe_2O_3$) | 20.73 |
| Others | 6.82 |

A deashing pretreatment (or conditioning) process is described and claimed in U.S. patent application Ser. No. 202,580 filed in the name of Frank Solomon on Oct. 31, 1980, and entitled "Active Carbon Conditioning Process." The disclosure of this application is incorporated herein by reference. Such deashing does not totally remove the ash content from the active carbon but results in a substantial reduction thereof, viz., from about 70 to 80 percent or more of the ash is removed by this process. The resulting deashed active carbon characteristically contains less than about 4 weight percent ash.

The initial stage of treatment constitutes contacting the active particles as obtained, e.g., RB carbon, as mentioned above, with either an acid or an alkali followed by contact with the other. For example, during the base contacting stage, the alkali material, such as sodium hydroxide, potassium hydroxide, etc., is maintained at elevated temperatures ranging from about 90° to about 140° C. and several contacting steps are used over time periods of, e.g., 0.5 to 25 hours, followed by one or more intermittent water washing step(s).

Then the thus treated active carbon is contacted with an acid, such as hydrochloric acid, for similar extended time periods at ambient temperatures. Between the alkali and acid contacting phases, the active carbon particles can optionally be dried.

The active carbon preferably has a particle size ranging from about 1 to about 50 microns, and more usually from about 10 to about 20 microns, an ash content of less than about 4 weight percent, and a B.E.T. surface area of from about 1000 $m^2/g$ and higher, e.g., 1000 to 2000+$m^2/g$.

The conditioning or deashing pretreatment results in substantial reduction of the aforementioned ash content of the active carbon particle along with increases in surface area. Typically, when utilizing active carbon having an initial B.E.T. surface area of 600 to 1500 $m^2/g$ (square meters per gram) of carbon before deashing and pretreating it with alkali and acid, reductions of ash content from about 12 weight percent to less than about 4 weight percent have been accomplished along with increases in surface area of up to 50 percent.

After deashing the active carbon, it can be catalyzed, e.g., with a precious metal, e.g., silver, by contacting the active carbon with a silver nitrate solution composed of silver nitrate salt dissolved in water as a solvent therefore. Other suitable water-soluble silver (precursor) salts which can be employed in the deposition step include, but are not necessarily limited to, silver perchlorate, silver acetate, silver lactate, etc. According to a preferred embodiment of this invention, the active carbon is permitted to soak in the silver nitrate solution to adsorb and absorb silver nitrate over a period ranging from about 1.5 to 2.5 hours at ambient room temperatures. The silver nitrate concentration in the solvent can range anywhere from about 0.1 to 0.5 molar and usually ranges from about 0.2 to 0.4 molar silver nitrate.

Subsequent to the soak in silver nitrate to permit adsorption of the silver nitrate within the pores of the active carbon, the excess silver nitrate is filtered off the active carbon to reduce the amount of silver solution retained outside of the active carbon particles.

A chemical reduction step is then conducted in the absence of bulk $AgNO_3$ solution using hot alkaline formaldehyde or similar reducing agents, viz., about an 85° C., solution of alkaline formaldehyde accompanied with strong stirring, thus effecting chemical reduction of silver nitrate to metallic silver. This process of preparing a silver-containing active carbon catalyst and the catalyst so obtained is described and claimed in U.S. patent application Ser. No. 202,579 filed in the name of Frank Solomon on Oct. 31, 1980, and entitled "Process For Catalyst Preparation." Of course, other catalyst materials can be deposited on the active carbon, e.g., platinum, can be applied according to the procedure set forth in U.S. Pat. No. 4,044,193.

Characteristically, the catalyzed or uncatalyzed carbon-containing active layer utilized to form the electrodes in accordance with this invention can contain a particulate hydrophobic agent, preferably PTFE in addition to the carbon particles. The particulate PTFE can have individual particle sizes ranging from about 0.01 to about 1.0 micron. Usually, however, the PTFE particle size ranges from about 0.05 to about 0.5 micron. It will be observed that the particle size of the PTFE particles is significantly smaller than that of porous active carbon particles but larger than that of porous high surface area carbon black particles. The carbon black or active carbon particles characteristically are combined intimately with the PTFE particles in a procedure referred to as "Teflonating."

In combining porous, high surface area carbon particles with the PTFE particles, more high surface area carbon is used than PTFE. Thus the concentration of PTFE in the carbon/PTFE mix ranges from about 10 to 40 weight parts of PTFE and from about 60 to 90 weight parts of high surface area carbon to make up 100 weight parts of mix upon drying. More usually, however, the concentration of PTFE ranges from about 20 to 35 weight parts per 100 weight parts of dried mix with the remaining about 65 to about 80 weight parts being high surface area carbon particles. Subsequently the "Teflonated" carbon black is dried to remove substantially all of the water therefrom and then redispersed in a lower alkyl alcohol, such as isopropanol. A pore-forming agent is added to the alcohol dispersion.

In accordance with a preferred procedural embodiment of this invention, the active layer is formed on the metal plaque substrate layer 13 by using said plaque layer 13 as a filter medium. Hence, the previously described active material is deposited upon the upper surface, U, of porous plaque substrate, 13, from a liquid medium, e.g., isopropyl alcohol.

Depositing the active layer upon the upper surface, U, of the porous plaque substrate enables the deposition of a thin, e.g., from about 1 to about 15 mil thick active layer. The active layer is well-bonded to the upper surface of the plaque substrate by filtering into the anchor site depressions, 16', therein, thereby forming what can be considered or visualized as anchor portions, 17, of the lower portion of the active layer with the plaque substrate.

Once the active layer has been deposited, such as in the manner described above, upon the silver-containing porous plaque substrate; the wetproofing layer can then be deposited upon the upper surface of the active layer also preferably by filtration.

In accordance with one embodiment of this invention, the wetproofing (backing) contains PTFE and pore-former only. According to another embodiment of this invention, the backing layer contains chiefly PTFE and carbon black included so as to render the backing more electrically conductive. According to a further embodiment of this invention, the backing layer contains PTFE, a pore former and a fluorinated graphite of the formula $CF_x$, where x may range from about 0.1 to about 0.4. Such fluorinated graphites are very hydrophobic and still conductive.

VARIATIONS IN FORMING THE ELECTRODE

In accordance with this invention, the active layer can contain a mixture of platinum and carbon particles, e.g., from about 9 to 19 weight parts of carbon per weight part of platinum. The platinum area density in respect to the surface area of the electrode can be maintained at approximately less than one milligram of platinum per $cm^2$ of electrode (including any PTFE which may be contained in the active layer).

In cases where it is desired to make an oxygen cathode operating on oxygen only (and not air), silver can be employed with PTFE in the active layer with or without carbon particles. In such cases, high surface area silver is employed.

According to another embodiment of this invention, platinum can be laid down as an active layer (with or without carbon) in conjunction with PTFE by laying down the platinum on the silver-containing porous plaque substrate in the form of hydrous platinum oxide with the PTFE in the form of an aqueous dilute dispersion of DuPont "Teflon 30" thereby forming a coagulum. Alternatively, the platinum hydrous oxide can be sprayed on the back of the PTFE and sintered to obtain graded hydrophobicity.

In accordance with a further embodiment of this invention, graphite carbon fiber can be added to the active layer to decrease its compressibility during the pressing operation and thereby maintain high porosity within the active layer portion of the gas electrode. The use of graphite fiber can also be employed to add strength to the active layer mixtures. Alternatively, PTFE fibers can be employed.

The invention will be illustrated in further detail in the example which follows. In the example, all parts, ratios and percents are by weight unless otherwise indicated.

EXAMPLE

Minus 270 mesh Al powder (53 microns or less diameter) was pressed into the surface of an unsintered silver plaque and then sintered for one hour at 1000° F. Al was then extracted with 38 percent KOH, and the roughened sintered silver plaque was then washed and dried.

A disc of 2⅛" diameter was placed in the filter apparatus, rough side up. The "rough" side is the side containing the anchor site depressions created by dissolving the particles of Al. 95 mg of active material, i.e., 80 percent RB carbon, deashed as described herein by acid then alkali contact, and catalyzed with silver and containing fuel cell grade Pt, and 20 percent Teflon (as coagulated "Teflon 30") were mixed with 250 ml isopropyl alcohol in a Waring Blender and then filtered on the silver plaque.

200 mg of 75 percent $CF_{0.18}$ and 25 percent "Teflon 30" were then similarly filtered on top of the 95 mg of active material to form the hydrophobic (wetproofing) layer for the air side of oxygen cathode.

The wet filtered electrode was press-dried at 3000 psi and 250° F., then sintered in argon at 300° C. and, finally, pressed at 2000 psi and 250° F.

This electrode was tested in 30 percent NaOH at 62° C. at increasing current densities. At the highest current density, 300 ma/cm$^2$, voltage was 0.270 v negative to a standard Hg/HgO at first. A day later, voltage had improved to −0.228 v, thus demonstrating the feasibility of the present invention.

I claim:

1. A method for preparing an oxygen cathode comprising rolling or pressing silver powder into a plaque substrate and including an extractable particulate material on one surface thereof; sintering the plaque containing said extractable material; removing said extractable material to produce a plaque electrode substrate having anchor site depressions in one surface; depositing an active layer material containing catalyzed or uncatalyzed carbon on said one surface and then depositing a layer of hydrophobic backing material on said active layer.

2. A method as in claim 1 wherein said metal is silver and said extractable material is a soluble material which is removed by contact of said one surface with a solvent for said extractable material but which does not dissolve the remainder of said substrate.

3. A method as in claim 2 wherein said extractable material is aluminum powder.

4. A method as in claim 1 wherein said extractable particulate material is generally spherically shaped and has an average size of from about 40 to about 120 microns.

5. A method as in claim 4 wherein said active layer is deposited by filtration of a dispersion containing catalyzed carbon particles and polytetrafluoroethylene particles onto the plaque surface containing said depressions.

6. A process as in claim 5 wherein said hydrophobic backing layer is deposited by filtering a dispersion containing particulate polytetrafluoroethylene on said active layer.

* * * * *